US006971369B1

(12) United States Patent
Mitchell et al.

(10) Patent No.: US 6,971,369 B1
(45) Date of Patent: Dec. 6, 2005

(54) PRESSURE ASSISTED GOVERNOR

(75) Inventors: Robert K. Mitchell, Pewaukee, WI (US); Richard W. Seilenbinder, Hales Corners, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 10/980,563

(22) Filed: Nov. 3, 2004

(51) Int. Cl.[7] ..... F02D 31/00
(52) U.S. Cl. ..... 123/376; 123/400; 123/401
(58) Field of Search ..... 123/376, 384, 123/389, 400, 401

(56) References Cited

U.S. PATENT DOCUMENTS

| | | | | |
|---|---|---|---|---|
| 2,134,889 A | | 11/1938 | Phillips | |
| 2,529,437 A | | 11/1950 | Weinberger | |
| 2,544,607 A | | 3/1951 | Mallory | |
| 2,867,196 A | | 1/1959 | Francis | |
| 3,139,079 A | | 6/1964 | Bettoni | |
| 3,659,499 A | | 5/1972 | Woodward | |
| 4,103,652 A | | 8/1978 | Garside | |
| 4,342,299 A | * | 8/1982 | Haka | 123/396 |
| 4,391,246 A | * | 7/1983 | Kawabata et al. | 123/389 |
| 4,660,518 A | * | 4/1987 | Tamaki | 123/328 |
| 4,944,267 A | * | 7/1990 | Mann | 123/339.28 |
| 5,003,949 A | | 4/1991 | Fanner et al. | |
| 5,146,889 A | | 9/1992 | Swanson et al. | |
| 2004/0112333 A1 | * | 6/2004 | Mitchell et al. | 123/376 |

FOREIGN PATENT DOCUMENTS

| | | |
|---|---|---|
| GB | 14915 | 10/1915 |
| SU | 853138 | 11/1979 |

* cited by examiner

*Primary Examiner*—Hai Huynh
(74) *Attorney, Agent, or Firm*—Michael Best & Friedrich LLP

(57) ABSTRACT

A governor for an internal combustion engine having an intake passageway and an engine throttle valve movable between an open position and a closed position, a throttle arm connected to the engine throttle valve to control movement of the engine throttle valve. A pressure assist adjusts the position of the throttle arm when a load is applied to the engine. The pressure assist includes a pressure responsive actuator having a pressure chamber in fluid flow communication with the intake passageway. The pressure responsive actuator is movable in a first direction in response to a pressure or a vacuum in the intake passageway. The throttle arm is movable in response to movement of the pressure responsive actuator. A conduit connects the pressure chamber and the intake passageway in fluid flow communication. A one-way valve is disposed in the conduit between the pressure chamber and the intake passageway.

31 Claims, 5 Drawing Sheets

PRESSURE ASSISTED GOVERNOR

FIELD OF THE INVENTION

This invention relates to internal combustion engines, and more particularly to a mechanical governor for internal combustion engines.

BACKGROUND OF THE INVENTION

Governors are generally used to regulate the speed of an internal combustion engine and maintain the engine at a relatively stable speed. The governor generally receives an input indicative of engine speed, and moves an engine throttle accordingly to adjust the engine speed to a desired speed. A governor spring opposes the movement of the throttle, such that the governed speed of the engine is determined by the interplay between the movement of the throttle valve and the spring force and tension of the governor spring.

The engine speed drops when a load is applied to the engine. This drop in engine speed is called "speed droop". The speed droop generally results in an undesirable loss of horsepower output when higher loads are applied on the engine. The amount of speed droop is a characteristic of a particular engine, and is in part determined by spring rate and the tension applied to the governor by the governor spring. Attempts to reduce the speed droop by changing the spring rate of the governor spring may cause the governor to be overly sensitive to small changes in engine load, resulting in an instability of engine speed.

SUMMARY OF THE INVENTION

The present invention provides an apparatus that helps control the speed of an internal combustion engine having an engine throttle. The apparatus comprises a mechanical governor for an internal combustion engine, the engine having an intake passageway and an engine throttle valve movable between an open position and a closed position. The governor comprises a throttle arm connected to the engine throttle valve to control movement of the engine throttle valve. A speed responsive device is movable in response to the speed of the engine, and a linkage moves the throttle arm in response to the speed responsive device. A pressure assist adjusts the position of the throttle arm when a load is applied to the engine. The pressure assist includes a pressure responsive actuator having a pressure chamber in fluid flow communication with the intake passageway. The pressure responsive actuator is movable in a first direction in response to a positive pressure or a partial vacuum pressure in the intake passageway. The throttle arm is movable in response to movement of the pressure responsive actuator. A conduit connects the pressure chamber and the intake passageway in fluid flow communication. A one-way valve is disposed in the conduit between the pressure chamber and the intake passageway.

In one embodiment, the pressure responsive actuator includes a cylinder and a piston movable in relation to the cylinder. The piston is coupled to the throttle arm, and the throttle arm is movable in response to movement of the piston. The piston has a first end and a second end, and the pressure chamber is at least partially defined by the cylinder and the first end. The conduit connects the pressure chamber to the intake passageway upstream of the engine throttle valve. The pressure actuator may include a pressure release mechanism that removes the influence of the pressure responsive actuator on the throttle arm and permits the pressure responsive actuator to move in a second direction opposite the first direction. The release mechanism may include a gap between the piston and the cylinder.

The governor having the pressure assist reduces the permanent droop experienced when a high load is applied on the engine. A partial vacuum is generally created within the intake passageway when a load is applied to the engine. The pressure responsive actuator moves in response to the partial vacuum in the intake passageway. The movement of the pressure responsive actuator adjusts the throttle arm to open the throttle and increase engine speed in response to the high load on the engine. The force applied on the throttle arm by the pressure responsive actuator is a temporary force initially applied during a high load on the engine. The release mechanism removes the force applied by the pressure responsive actuator and permits the governor to return to normal operation under low loads.

Independent features and independent advantages of the present invention will become apparent to those skilled in the art upon review of the following detailed description and drawings.

Figure 1:
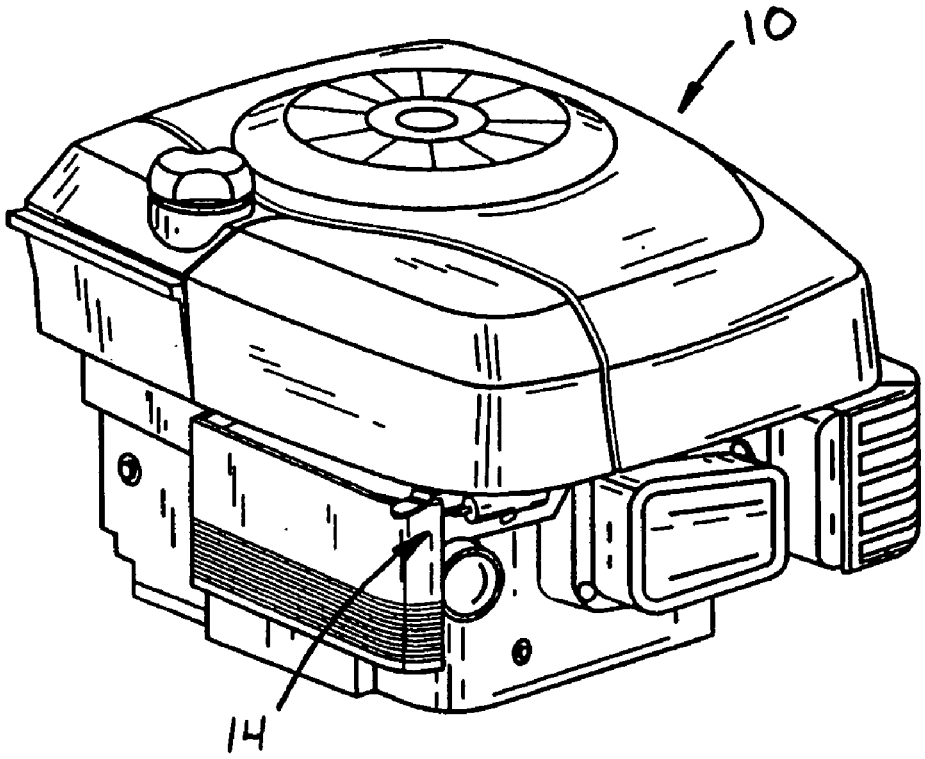
FIG. 1 is a perspective view of an engine including a governor having a pressure assist according to the present invention.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

Although references may be made below to directions, such as left, right, up, down, top, bottom, front, rear, back, etc., in describing the drawings, these references are made relative to the drawings (as normally viewed) for convenience. These directions are not intended to be taken literally or limit the present invention in any form.

DETAILED DESCRIPTION

Figure 2:
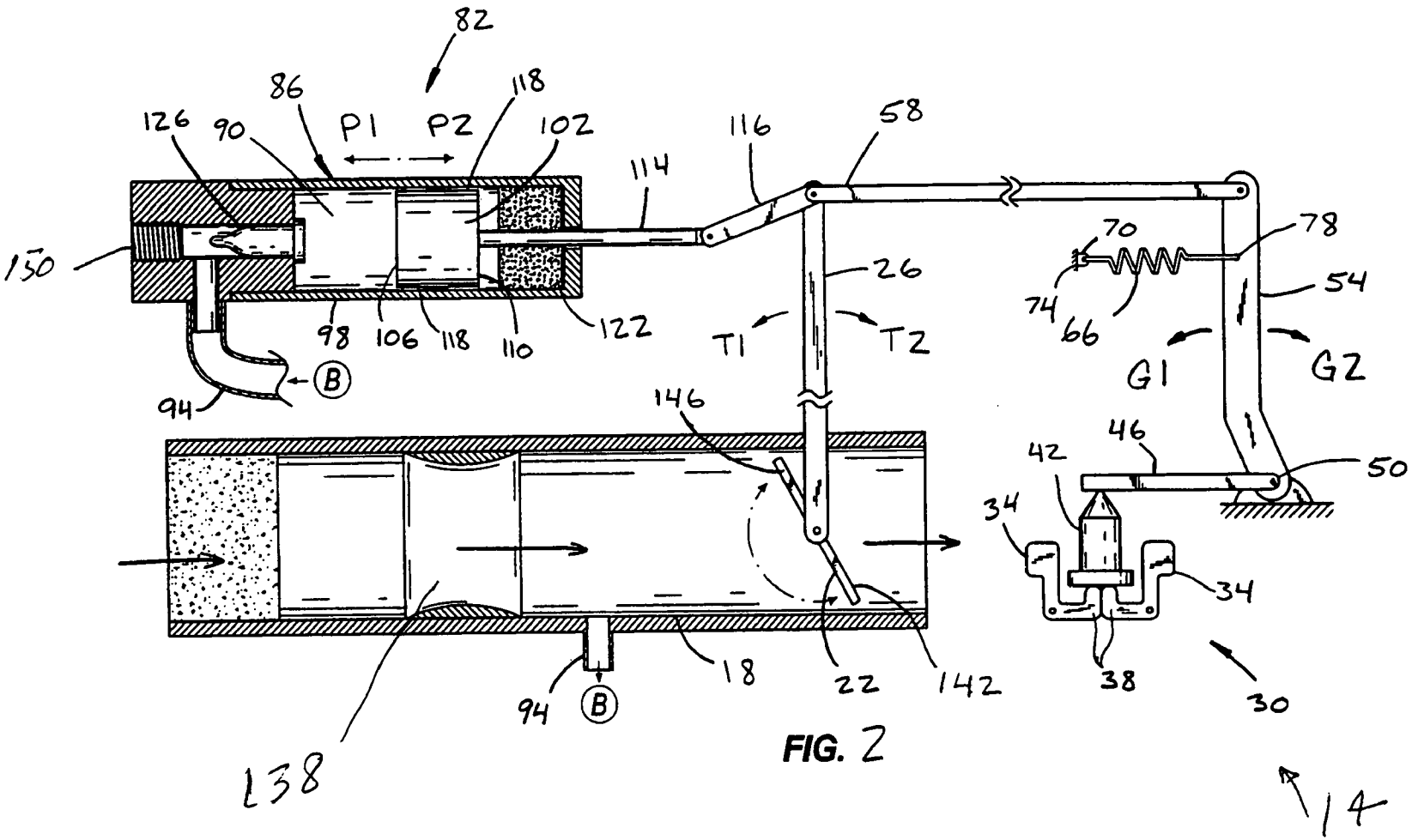
FIG. 2 is a diagram of a governor having a pressure assist according to the present invention.

FIG. 1 illustrates an internal combustion engine 10 having a mechanical governor 14 with a vacuum assist mechanism. The governor regulates the speed of the engine and the vacuum assist mechanism helps reduce droop of the governor 14. FIG. 2 illustrates a diagram of a construction of the governor 14 having the vacuum assist mechanism. The engine 10 (FIG. 1) includes an intake passageway 18 and an engine throttle or throttle valve 22 movable between an open position and a closed position. The governor 14 includes a throttle arm 26 connected to the engine throttle 22 to control movement of the engine throttle 22. The governor 14 also includes a speed responsive device 30 movable in response to the speed of the engine.

As shown in FIG. 2, the speed responsive device 30 includes centrifugally-responsive flyweights 34 having flanges 38 that move a plunger 42 in response to engine speed. Plunger 42 then moves a governor extension 46. The centrifugally-responsive flyweights 34 respond to the engine speed, and the flanges 38 cause the plunger 42 to move toward the governor extension 46 as the engine speed increases, and away from the governor extension 46 as the engine speed decreases. Flyweights 34 are interconnected with a pinion gear (not shown) that is typically driven by another gear such as the cam gear, as well-known in the art.

In the illustrated construction, the governor extension 46 is interconnected to a governor shaft 50, and the shaft 50 is interconnected to a governor arm 54. The shaft 50 extends between the governor extension 46 and the governor arm 54. In the illustrated construction, the shaft 50 extends substantially transverse to the governor arm 54, and the governor extension 46 extends in a substantially transverse direction from the shaft 50. However, the governor extension 46, governor shaft 50, and governor arm 54 may be interconnected at a variety of angles. The governor shaft 50 may be used to offset the flyweights 34 and plunger 42 from the governor arm 54. Alternatively, the governor extension 46 may be connected to the governor arm 54, and the shaft 50 may not be needed. In other constructions, the speed responsive device 30 may act directly on the governor arm 54.

As shown in FIG. 2, the flyweights 34 cause the plunger 42 to move the governor extension 46 in response to engine speed. The governor extension 46 pivots with respect to the shaft 50 in response to movement of the plunger 42. The governor arm 54 is mounted to pivot with respect to the engine 10 (FIG. 1). The pivoting movement of the governor extension 46 causes the shaft 50 to rotate, and rotation of the shaft 50 causes the governor arm 54 to pivot with respect to the engine 10 (FIG. 1). The governor arm 54 may pivot in a first direction G1 when engine speed decreases, and a second opposite direction G2 when engine speed increases.

A linkage 58 moves the throttle arm 26 in response to movement of the speed responsive device 30. As shown in FIG. 2, the linkage 58 includes a throttle link interconnected to the governor arm 54 and to the throttle arm 26. The throttle valve 22 regulates the air flow that passes through the intake passageway 18 to control engine speed, and the throttle link actuates the throttle valve 22. The throttle valve 22 is pivotally connected within the intake passageway 18 and the throttle arm 26 is interconnected with the throttle valve 22. The throttle arm 26 is pivotally movable to control pivotal movement of the throttle valve 22. The linkage 58 is connected to the throttle arm 26 and the governor arm 54, and the throttle arm 26 pivots in response to pivotal movement of the governor arm 54.

The governor 14 also includes a governor spring 66 that applies a biasing force on the governor arm 54. The governor spring 66 includes a first end 70 connected to a fixed portion 74 on the engine 10 (FIG. 1), and a second end 78 connected to a moving part of the governor 14. In the illustrated construction, the second end 78 of the governor spring 66 is connected to the governor arm 54, and the governor spring 66 applies a biasing force on the governor arm 54 that biases the governor arm 54 in the first direction G1.

Many alternatives of the governor 14 configuration may be used with the present invention. For example, the second end 78 of the governor spring 66 may be connected to the linkage 58. In the illustrated embodiment, the governor spring 66 is a coil spring, but it could also be a leaf spring, or another type of spring. The linkage 58 and governor spring 66 could extend from the governor arm 54 in different directions. The governor spring 66 may be connected to a selectively movable speed adjustment instead of a fixed portion 74 of the engine 10 (FIG. 1) to vary the speed setting of the governor 14.

As shown in FIG. 2, the governor 14 includes a vacuum assist mechanism or pressure assist 82 that adjusts the position of the throttle arm 26 in response to a pressure or partial vacuum within the intake passageway 18. The pressure assist 82 includes a pressure responsive actuator 86 having a pressure chamber 90 in fluid flow communication with the intake passageway 18. A conduit 94 connects the pressure chamber 90 and the intake passageway 18 in fluid flow communication. The conduit 94 may include a continuous flexible tube extending between the intake passageway 18 and the pressure chamber 90. In FIG. 2, the conduit 94 is shown as having a break B to simplify the illustration. The break B represents the connection between the illustrated portions of the conduit. The conduit 94 extends from the intake passageway 18 and reaches break B and proceeds from break B to the pressure chamber 90. In the illustrated construction, the conduit 94 is connected to the intake passageway 18. In other aspects and in other constructions, the conduit 94 may be connected to the crankcase, the carburetor, or other portions of the intake passageway.

The pressure responsive actuator 86 is movable in response to one of a pressure and a partial vacuum in the intake passageway 18. The pressure responsive actuator 86 is connected to the linkage 50, and the throttle arm 26 is movable in response to movement of the pressure responsive actuator 86. As described herein, the term "pressure" may include a positive pressure and a negative pressure (or partial vacuum). In some aspects and in some constructions, the pressure assist 82 may be responsive to either a positive pressure or a negative pressure (or partial vacuum). In the illustrated construction, the pressure assist 82 is responsive to a partial vacuum, or negative pressure, within the intake passageway 18. In other aspects and in other construction, the pressure assist 82 may be configured to be responsive to a positive pressure.

In the illustrated construction, the pressure responsive actuator 86 includes a cylinder 98 and a piston 102 disposed within the cylinder 98 and movable in relation to the cylinder 98. The piston 102 has a first end 106 and a second end 110 opposite the first end 106. The pressure chamber 90 is at least partially defined by the cylinder 98 and the first end 106 of the piston 102. The piston 102 is movable in a first direction P1 in response to one of a pressure and a vacuum within the pressure chamber 90, and is also movable in a second direction P2 opposite the first direction P1.

A piston rod 114 extends outwardly from the second end 110 of the piston 102 and out of the cylinder 98. The second end 110 may be exposed to ambient air. At least one link 116 connects the piston rod 114 and the throttle arm 26, and the throttle arm 26 is movable in response to movement of the piston 102. The link 116 permits the piston rod 114 to move in a linear direction and the throttle arm 26 to move in a pivotal direction.

A change in pressure within the intake passageway 18 is transferred to the pressure chamber 90 through the conduit 94. For example, an increase in negative pressure within the pressure chamber 90 will cause the piston 102 to move in the first direction P1 relative to the cylinder 98 and thereby cause an influencing force on the throttle arm 26.

The pressure assist 82 may include a return means for moving the pressure responsive actuator in a second direction P2 opposite the first direction P1. The return means may include a mechanical means that actuates the piston 102 in the second direction P2, a biasing member that returns the piston 102, or a similar means that counteracts the force on the piston 102 or removes the force on the piston 102 to permit the piston 102 to move in the second direction P2 and return to a neutral position. The return means may also include a release mechanism that relieves the positive or negative pressure in the pressure chamber 90 and removes the influence of the pressure responsive actuator 86 on the throttle arm 26. The release mechanism permits the pressure responsive actuator 86 to move in the second direction P2 opposite the first direction P1.

In the illustrated construction, the release mechanism includes an opening 118 at least partially defined by the pressure chamber 90. The opening 118 may include a gap between the piston 102 and the cylinder 98. The cross-sectional area of the piston 102 is less than the cross-sectional area of the cylinder 98 to create a gap or opening 118 between the piston 102 and cylinder 98. The piston 102 does not form an air-tight seal with the cylinder 98. After the vacuum in the pressure chamber 90 causes movement of the piston 102, the gap or opening 118 between the piston 102 and cylinder 98 permits a pressure equalizing fluid, such as ambient air or crankcase gases, to enter pressure chamber 90 and relieve the positive or negative pressure in the pressure chamber 90. The piston 102 may then move in the second direction P2, return to a neutral position and no longer influence movement of the throttle arm 26.

A filter 122 may be disposed within the cylinder 98 near the second end 110 of the piston 102. Ambient air passes through the filter 122 when entering the cylinder 98. Once inside the cylinder, ambient air may pass through the gap or opening 118 between the piston 102 and cylinder 98 and enter the pressure chamber 90. The filter 122 helps prevent particles or debris from entering the cylinder 98 or pressure chamber 90. As shown in FIG. 2, the pressure chamber 90 is connected in fluid flow communication to the intake passageway 18 through the conduit 94. Therefore, ambient air passing through the filter 122 may eventually flow through the conduit 94 to the intake passageway 18 and enter the combustion chamber. The filter 122 helps prevent undesirable material from entering the combustion chamber of the engine 10 (FIG. 1).

The governor 14 includes a one-way valve 126 disposed in the conduit 94 between the pressure chamber 90 and the intake passageway 18. The one-way valve 126 restricts air flow between the intake passageway 18 and pressure chamber 90. In the illustrated construction, the one-way valve 126 only permits air flow from the pressure chamber 90 to the intake passageway 18. When there is a partial vacuum within the intake passageway 18, the partial vacuum draws an air flow from the pressure chamber 90, through the one-way valve 126 and conduit 94 and exposes the pressure chamber 90 to the partial vacuum. The vacuum within the pressure chamber 90 causes the piston 102 to move in the first direction P1 in relation to the cylinder 98, which also causes the piston rod, linkage, and throttle arm to be moved.

When there is a positive pressure in the intake passageway 18, the pressure will generally cause an air flow from the intake passageway 18 into the conduit 94. Under this condition, the one-way valve 126 remains closed and restricts air flow from the intake passageway 18 into the pressure chamber 90. The pressure chamber 90 is not exposed to a positive pressure within the intake passageway 18 and the piston 102 does not move relative to the cylinder 98 in response to a positive pressure. The pressure responsive actuator 86 does not pivot the throttle arm 26 in response to a positive pressure in the intake passageway 18.

In the illustrated construction, the one-way valve 126 includes a duckbilled valve. The valve 126 includes two flaps that engage one another to create a seal. The flaps are forced apart by air flow in a first direction to permit air flow through the valve, and are forced together by air flow in a second opposite direction to form the seal and restrict air flow the valve. Therefore, air flow is only permitted in one direction through the one-way valve 126. Other similar one-way valves, such as single flap valves, may be substituted for the duckbilled one-way valve 126.

Figure 3:
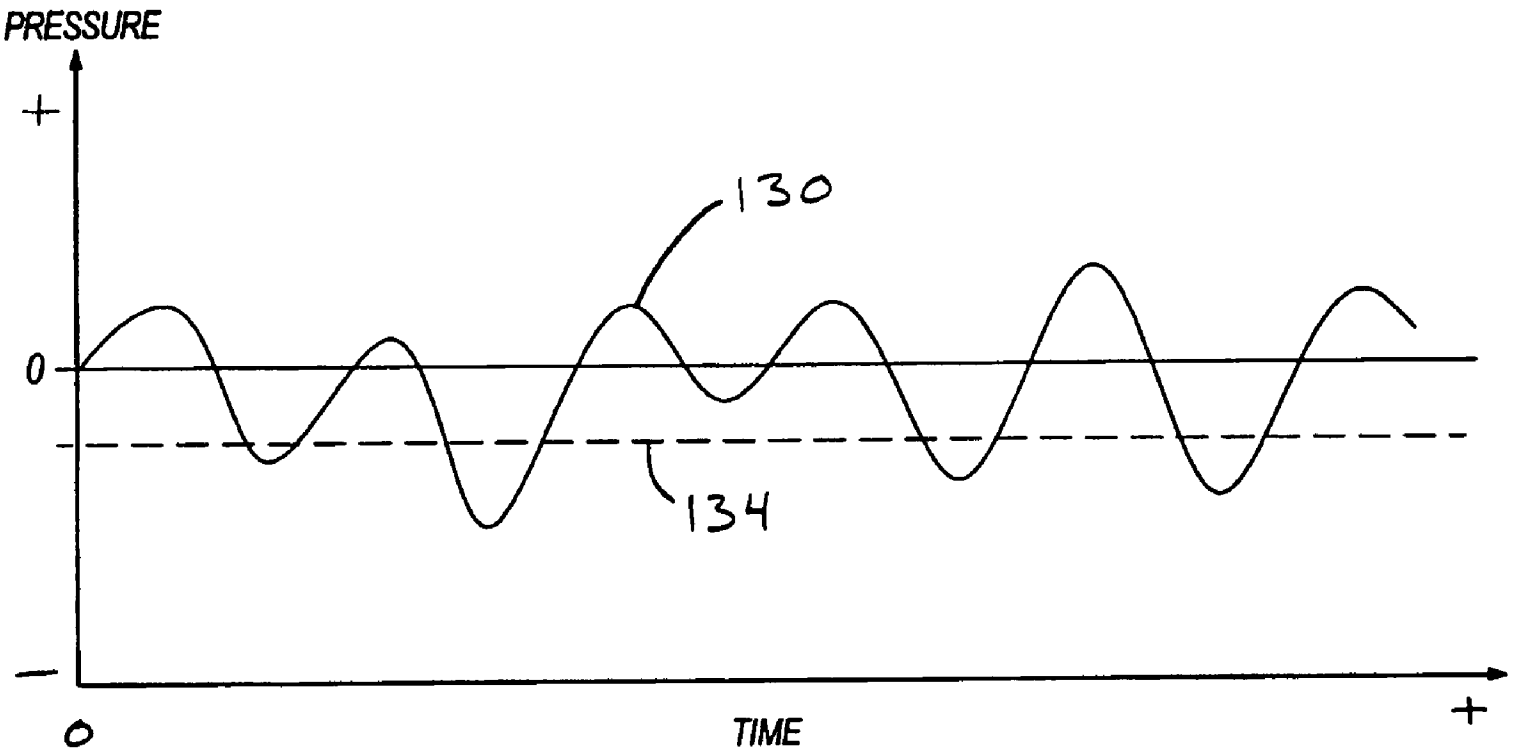
FIG. 3 is a graph illustrating pressure in response to time within an intake passageway of an engine with the governor having the pressure assist of FIG. 2.

As shown in FIG. 3, the pressure in the intake passageway 18 (FIG. 2) may fluctuate from a positive pressure to a negative pressure, or partial vacuum. In FIG. 3, a solid line 130 illustrates the pressure within the intake passageway 18 (FIG. 2) over time. A dashed line 134 illustrates the cut-off point at which the one-way valve 126 (FIG. 2) permits flow between the pressure chamber 90 (FIG. 2) and intake passageway 18 (FIG. 2). The one-way valve 126 (FIG. 2) opens and permits air flow through the valve for a negative pressure or partial vacuum below the dashed line 134. Therefore, the pressure chamber 90 (FIG. 2) is only exposed to the peak negative pressures within the intake passageway 18 (FIG. 2).

In FIG. 2, the pressure responsive actuator 86 generally influences movement of the throttle valve 22 to reduce droop during high engine loads when a partial vacuum is present in the intake passageway 18. During normal engine operation, the engine runs at a substantially constant speed and the speed responsive device 30 rotates at a substantially constant set speed. When a low load is applied on the engine, the load will cause the engine speed to be slightly reduced initially. As the engine speed is reduced, the flyweights 34 of the speed responsive device 30 will move inwardly and reduce the force applied on the plunger by the flanges 38. The plunger 42 will retract due to the reduction in force from the flanges 38 and the force from the governor extension 46. The governor spring 66 will then bias the governor arm 54 in the first direction G1, and the linkage 58 will in turn move the throttle arm 26 and pivot the throttle valve 22 toward an open position to permit more air flow through the intake passageway 18. Since the load is a low load, the movement of the throttle valve 22 will be relatively slow and small and may cause a gradual change in the pressure or vacuum within the intake passageway 18.

The gradual change in the partial vacuum will not produce a significant effect on the pressure responsive actuator 86. The slow and small change in vacuum may not be enough to open the one-way valve 126. If the one-way valve 126 is opened under relatively low loads, the opening or gap 118 between the piston 102 and cylinder 98 may provide enough air flow to relieve the partial vacuum and equalize the pressure within the pressure chamber 90. Therefore, the pressure responsive actuator 86 does not respond to relatively low loads applied on the engine 10 (FIG. 1) that are below a predetermined level.

When a relatively high load is suddenly applied on the engine 10 (FIG. 1), the engine speed is reduced suddenly and significantly due to the resistance placed on the engine (FIG. 1). As the engine speed decreases, the flyweights 34 will move inwardly and the plunger 42 will retract a relatively large amount. The removal of the force from the plunger 42 on the governor extension 46 permits the governor spring 66 to retract and bias the governor arm 54 in the first direction G1. The movement of the governor arm 54 will also cause the throttle arm 26 to pivot and open the throttle valve 22 and permit greater airflow through the intake passageway 18. The relatively high load creates an increased demand for air within the combustion chamber, so a large partial vacuum is created in the intake passageway as the air flows past the open throttle valve 22.

The vacuum within the intake passageway 18 upstream of throttle valve 22 is substantially larger and occurs more quickly during high loads than during low loads. The quick and large increase in such a partial vacuum within the intake passageway 18 opens the one-way valve 126 and is transferred to the pressure chamber 90. The quick and large increase in partial vacuum will draw the piston 102 in the first direction P1. The throttle arm 26 will pivot in the first throttle direction T1 to further open the throttle valve 22 in response to movement of the piston 102 in the first direction P1. Further opening the throttle valve 22 will permit more air to enter the engine and increase the engine speed to the desired speed.

The pressure responsive actuator 86 and the governor spring 66 move the throttle arm 26 in the same direction, and the pressure responsive actuator 86 functions as a temporary boost for the governor spring 66 and thus for the governor. This temporary boost helps reduce the droop experienced by the engine 10 (FIG. 1) when a high load is placed on the engine. The pressure responsive actuator 86 applies an additional force to assist the governor 14 when necessary and removes that force to permit the governor 14 to functional normally when the reduction in speed droop is not necessary.

In the illustrated construction, the pressure responsive actuator 86 is not connected to a biasing member or spring. There is no additional spring or biasing member acting on the throttle arm 26 besides the governor spring 66. The pressure responsive actuator 86 has a neutral position that does not influence the throttle arm 26. Therefore, the pressure responsive device has substantially no effect on the engine throttle when the engine is idling or under relatively low loads.

In addition, the pressure responsive actuator 86 has a default setting that has substantially no effect on the engine throttle valve 22 when the pressure responsive actuator 86 fails. If a hole would develop in the pressure chamber 90 or conduit 90, or if the conduit 94 would break or disconnect from the intake passageway 18 and expose the conduit to ambient air, the pressure responsive actuator 86 would have substantially no effect on the engine throttle valve 22. If the conduit 94 would break and the pressure chamber 90 is exposed to ambient air, the pressure on both sides of the piston 102 would be substantially equalized and the pressure responsive actuator 86 would have substantially no effect on the engine throttle. Therefore, the pressure responsive actuator 86 includes a neutral default setting that has substantially no effect on the engine throttle 22 during failure of the system.

In FIG. 2, the intake passageway 18 includes a venturi passageway 138 and the throttle valve 22, and the air generally flows in the direction from the venturi passageway 138 toward the throttle valve 22 and onward to the engine cylinder. The conduit 94 is connected to the intake passageway 18 upstream of the throttle valve 22. In the illustrated construction, the conduit 94 is connected to the intake passageway in fluid flow communication between the throttle valve 22 and the venturi passageway 138.

The throttle valve 22 includes a retracted side 142 that opens toward the downstream direction of air flow and a projected side 146 that opens toward the upstream direction of air flow. As shown in FIG. 2, the throttle valve 22 moves in a counter-clockwise direction as it opens. The conduit 94 is connected to the intake passageway 18 near the retracted side 142 of the throttle valve 22. As the throttle valve 22 opens, the slanted surface of the throttle valve 22 generally directs the air flow toward the retracted side 142. The increased air flow near the retracted side 142 produces a relatively larger partial vacuum near the retracted side 142 than near the projected side 146. Therefore, the conduit 94 is more sensitive to changes in vacuum near the retracted side 142 due to the increased air flow.

The pressure responsive actuator 86 of FIG. 2 may include an adjustment mechanism having a set-screw for adjusting the one-way valve 126. The set-screw may be screwed inwardly toward the one-way valve 126 or outwardly away from the one-way valve 126. The position of the set-screw adjusts the level of vacuum required to open the one-way valve 126 and permits fluid flow between the pressure chamber 90 and the conduit 94.

FIG. 3 illustrates the dashed line 134 indicating the threshold vacuum level that will open the one-way valve 126. Adjusting the adjustment mechanism or set-screw may adjust the level of the dashed line for the pressure responsive actuator 86.

Figure 4:
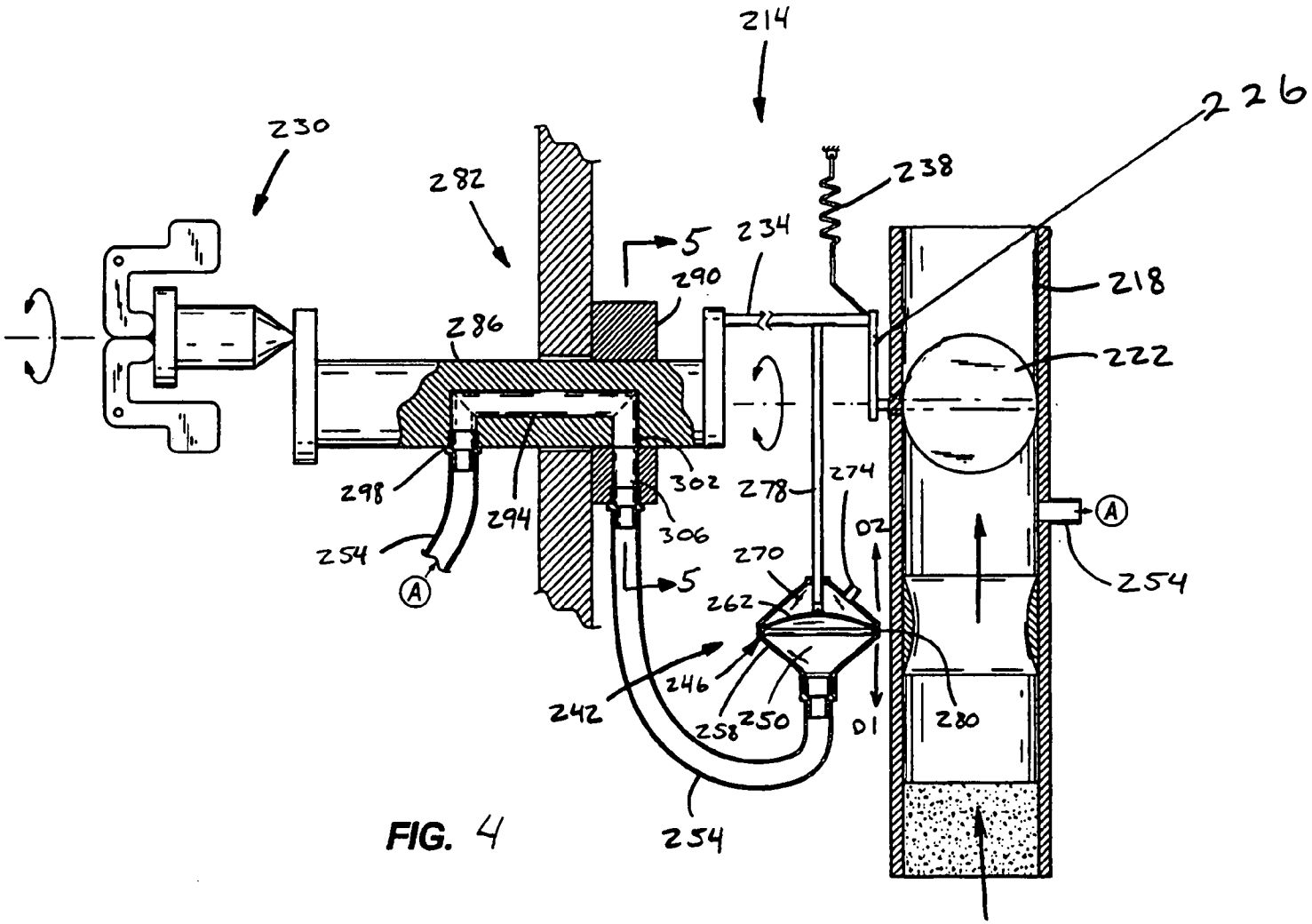
FIG. 4 is a diagram of another embodiment of a governor having a pressure assist according to the present invention.

FIG. 4 illustrates a second construction of a governor 214 for an engine having a vacuum assist mechanism. The second construction includes several elements that are similar to the elements of the first construction, described above. The engine includes an intake passageway 218 and an engine throttle or throttle valve 222 movable between an open position and a closed position. The governor 214 includes a throttle arm 226 connected to the engine throttle valve 222. A speed responsive device 230, similar to the speed responsive device 30 described above, is movable in response to the speed of the engine. A linkage 234 is connected to the speed responsive device 230 and the throttle arm 226, and the engine throttle valve 222 is movable in response to movement of the speed responsive device 230. A governor spring 238 is connected to the throttle arm 226 and biases the engine throttle valve 222 toward an open position.

The governor 214 includes a pressure assist 242 that may adjust the position of the throttle arm 226 when a load is applied to the engine. The pressure assist includes a pressure responsive actuator 246 having a pressure chamber 250 in fluid flow communication with the intake passageway 218. A conduit 254 connects the pressure chamber 250 and the intake passageway 218 in fluid flow communication. Conduit 254 is connected to the intake passageway 218 upstream of the throttle valve if a butterfly throttle valve is used, but either upstream or downstream of the throttle valve if a rotary throttle valve is used, or even to the engine crankcase. The pressure responsive actuator 246 is movable in response to one of a pressure and a partial vacuum in the intake passageway 218. The pressure responsive actuator 246 is connected to the linkage 234, and the throttle arm 226 is movable in response to movement of the pressure responsive actuator 246.

In FIG. 4, the conduit 254 is illustrated as having a break A to simplify the figure. The conduit 254 extends from the intake passageway 218 and reaches break A and proceeds from break A to the pressure chamber 250. In the illustrated construction, the conduit 254 is connected to the intake passageway 218.

As shown in FIG. 4, the pressure responsive actuator 246 includes a housing 258 having a diaphragm 262. The diaphragm 262 is movable in a first direction D1 in response to one of a pressure and a vacuum in the intake passageway 218, and is also movable in a second direction D2 opposite the first direction D1. The diaphragm 262 and the housing 258 at least partially define the pressure chamber 250 and an exposed chamber 270. The conduit 254 is connected to the housing 258 and is in fluid flow communication with the pressure chamber 250. The exposed chamber includes an aperture 274 and is exposed to ambient air. A diaphragm rod 278 extends from the diaphragm 262 and is connected to the linkage 234. The diaphragm 262 moves in response to a partial vacuum within the pressure chamber 250, and the throttle arm 226 is movable in response to movement of the diaphragm 262.

Similar to the first construction described above, the pressure responsive actuator 246 will open the engine throttle valve 222 when a partial vacuum is present within the intake passageway 218. The pressure responsive actuator 246 may include a one-way valve disposed within the conduit 254 near the connection of the conduit 254 and the housing 258 to restrict air flow between the housing 258 and intake passageway 218. The pressure responsive actuator 246 may also include a return mechanism, such as an opening or gap 280 between the housing 258 and diaphragm 262, that permits the diaphragm 262 to move in the second direction D2, opposite the first direction D1, and return to a neutral position. The opening or gap 280 may permit some air from the exposed chamber 270 to enter the pressure chamber 250 and substantially equalize the pressure on both sides of the diaphragm 262.

As shown in FIG. 4, the governor 214 includes a control valve 282 that regulates fluid flow communication through the conduit 254 between the pressure chamber 250 and the intake passageway 218. In the illustrated construction, the control valve 282 includes a rotary valve that places the pressure chamber 250 in fluid flow communication with the intake passageway 218 when an engine load exceeds a predetermined load, and that places the pressure chamber 250 in fluid flow communication with ambient air when the engine load is below a predetermined load.

The control valve 282 includes a shaft 286 supported for rotation with respect to a circular bracket 290. The shaft 286 defines valve passageway 294 extending radially inwardly from the surface of the shaft 286, extending in an axial direction along the center of the shaft 286, and extending radially outwardly back to the surface of the shaft 286. A first end 298 of the valve passageway 294 is connected to the conduit 254 leading to the intake passageway 218, and a second end 302 of the valve passageway 294 is disposed within the bracket 290.

In the illustrated construction, the control valve 282 is part of the linkage 234 connecting the speed responsive device 230 to the throttle arm 226. As described above, the speed of the speed responsive device 230 decreases when a load is applied on the engine. The shaft 286 will pivot about its rotational axis in response to movement of the speed responsive device 230. The control valve 282 permits air flow through the conduit 254 between the intake passageway 218 and pressure chamber 250 when the engine is under a high load.

Figure 5:
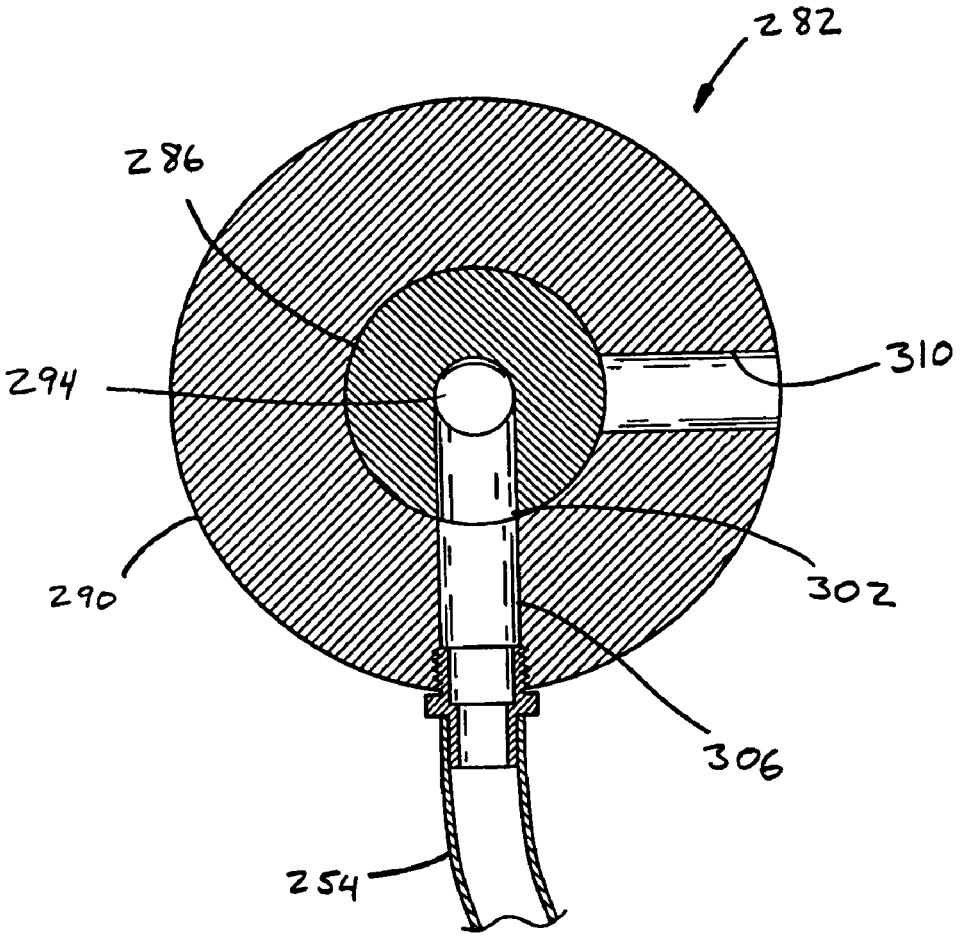
FIG. 5 is a cross-sectional view taken along line 5—5 of a portion of the governor having the pressure assist of FIG. 4.

FIG. 5 illustrates a cross-sectional view of the control valve 282 illustrating the shaft 286 and the bracket 290. The bracket 290 includes a conduit passageway 306 connected to the conduit 254 and an outer passageway 310 connected to ambient air or crankcase air (or other similar pressure equalizing fluid). As shown in FIG. 5, the second end 302 of the valve passageway 294 is aligned with the conduit passageway 306 to permit fluid flow through the conduit 254 between the intake passageway 218 and pressure chamber 250. The second end 302 of the valve passageway 294 is aligned with the conduit passageway 306 when the engine is under relatively high load. Therefore, the pressure chamber 250 is exposed to a partial vacuum within the intake passageway 218 when the engine is under high load and the pressure responsive actuator 246 may adjust the throttle arm 226 in response to the partial vacuum in the pressure chamber 250.

When the engine is under a relatively low load, the second end 302 of the valve passageway 294 is not aligned with the conduit passageway 306 and crankcase air or ambient air (or other pressure equalizing fluid) from the outer passageway 310 may enter the conduit passageway 306 and the pressure chamber 250. Under this condition, the pressure chamber 250 is exposed to ambient air and the pressure on both sides of the diaphragm 262 is substantially the same. Therefore, the diaphragm 262 is not actuated and does not influence the throttle arm 226.

The foregoing detailed description describes only a few of the many forms that the present invention can take, and should therefore be taken as illustrative rather than limiting. It is only the claims, including all equivalents that are intended to define the scope of the invention.

What is claimed is:

1. A governor for an internal combustion engine, the engine having an intake passageway and an engine throttle valve movable between an open position and a closed position, the governor comprising:

a throttle arm connected to the engine throttle valve to control movement of the engine throttle valve;

a speed responsive device that is movable in response to the speed of the engine;

a linkage that moves the throttle arm in response to the speed responsive device;

a pressure assist that adjusts the position of the throttle arm when a load is applied to the engine, the pressure assist including a pressure responsive actuator having a pressure chamber in fluid flow communication with the intake passageway, the pressure responsive actuator being movable in a first direction in response to one of a pressure and a vacuum in the intake passageway, and the throttle arm being movable in response to movement of the pressure responsive actuator;

a conduit connecting the pressure chamber and the intake passageway in fluid flow communication; and a one-way valve disposed in the conduit and between the pressure chamber and the intake passageway.

2. The governor of claim 1, wherein the pressure assist includes a release mechanism that removes the influence of the pressure responsive actuator on the throttle arm and permits the pressure responsive actuator to move in a second direction opposite the first direction.

3. The governor of claim 2, wherein the release mechanism includes an opening at least partially defined by the pressure chamber.

4. The governor of claim 3, wherein the pressure responsive actuator includes a cylinder and a piston movable in relation to the cylinder, the throttle arm being movable in response to movement of the piston, the piston having a first end and a second end, the pressure chamber being at least partially defined by the cylinder and the first end.

5. The governor of claim 4, wherein the opening includes a gap between the piston and the cylinder, the cross-sectional area of the piston being less than the cross-sectional area of the cylinder.

6. The governor of claim 4, further comprising a filter disposed near the second end of the piston, wherein a pressure equalizing fluid passes through the filter before being exposed to the piston.

7. The governor of claim 4, further comprising a piston rod connected to the second end of the piston and extending out of the cylinder, and at least one link connecting the piston rod and the throttle arm.

8. The governor of claim 1, wherein the pressure responsive actuator includes a diaphragm.

9. The governor of claim 8, further comprising a diaphragm rod extending from the diaphragm and being coupled to the throttle arm.

10. The governor of claim 1, wherein the pressure responsive actuator is not connected to a biasing spring.

11. The governor of claim 1, wherein the conduit includes a control valve that places the pressure chamber in fluid flow communication with the intake passageway when an engine load of the engine exceeds a predetermined load, and that places the pressure chamber in fluid flow communication with a pressure equalizing fluid when the engine load is below a predetermined load.

12. The governor of claim 1, wherein the conduit is connected to at least one of the intake passageway and the engine crankcase.

13. The governor of claim 1, wherein the intake passageway includes a venturi passageway and the throttle valve, the conduit being connected to the intake passageway between the venturi passageway and the throttle valve.

14. The governor of claim 1, wherein the pressure assist includes a return means for moving the pressure responsive actuator in a second direction opposite the first direction.

15. The governor of claim 14, wherein the return means includes a opening in the pressure chamber permitting a pressure equalizing fluid to enter the pressure chamber and equalize the pressure within the pressure chamber.

16. A pressure assist for a governor of an internal combustion engine, the engine having an intake passageway, an engine throttle valve movable between an open position and a closed position, and a throttle arm connected to the engine throttle valve to control movement of the engine throttle valve, the governor having a speed responsive device that is movable in response to the speed of the engine and a linkage that moves the throttle arm in response to the speed responsive device, the pressure assist comprising:

a pressure responsive actuator having a pressure chamber in fluid flow communication with the intake passageway, the pressure responsive actuator being movable in a first direction in response to one of a pressure and a vacuum in the intake passageway, and the throttle arm being movable in response to movement of the pressure responsive actuator;

a conduit connecting the pressure chamber and the intake passageway in fluid flow communication; and a one-way valve disposed in the conduit and between the pressure chamber and the intake passageway.

17. The pressure assist of claim 16, further comprising a release mechanism that removes the influence of the pressure responsive actuator on the throttle arm and permits the pressure responsive actuator to move in a second direction opposite the first direction.

18. The pressure assist of claim 17, wherein the release mechanism includes an opening at least partially defined by the pressure chamber.

19. The pressure assist of claim 18, wherein the pressure responsive actuator includes a cylinder and a piston movable in relation to the cylinder, the throttle arm being movable in response to movement of the piston, the piston having a first end and a second end, the pressure chamber being at least partially defined by the cylinder and the first end.

20. The pressure assist of claim 19, wherein the opening includes a gap between the piston and the cylinder, the cross-sectional area of the piston being less than the cross-sectional are of the cylinder.

21. The pressure assist of claim 20, further comprising a piston rod connected to the second end of the piston and extending out of the cylinder, and at least one link connecting the piston rod and the throttle arm.

22. The pressure assist of claim 19, further comprising a filter disposed near the second end of the piston, wherein a pressure equalizing fluid passes through the filter before being exposed to the piston.

23. The pressure assist of claim 16, wherein the pressure responsive actuator includes a diaphragm.

24. The pressure assist of claim 23, further comprising a diaphragm rod extending from the diaphragm and being coupled to the throttle arm.

25. The pressure assist of claim 16, wherein the pressure responsive actuator is not connected to a biasing spring.

26. The pressure assist of claim 16, wherein the conduit includes a control valve that places the pressure chamber in fluid flow communication with the intake passageway when an engine load of the engine exceeds a predetermined load, and that places the pressure chamber in fluid flow communication with a pressure equalizing fluid when the engine load is below a predetermined load.

27. The pressure assist of claim 16, wherein the conduit is connected to the intake passageway upstream of engine throttle valve.

28. The pressure assist of claim 16, wherein the intake passageway includes a venturi passageway and the throttle valve, the conduit being connected to the intake passageway between the venturi passageway and the throttle valve.

29. The pressure assist of claim 16, wherein the throttle valve is a rotary valve, and wherein the conduit is connected to at least one of the intake passageway and the engine crankcase.

30. The pressure assist of claim 16, wherein the pressure assist includes a return means for moving the pressure responsive actuator in a second direction opposite the first direction.

31. The pressure assist of claim 30, wherein the return means includes a opening in the pressure chamber permitting a pressure equalizing fluid to enter the pressure chamber and equalize the pressure within the pressure chamber.

* * * * *